US008618999B2

(12) United States Patent
Wu et al.

(10) Patent No.: US 8,618,999 B2
(45) **Date of Patent: *Dec. 31, 2013**

(54) MICROWAVE MOTION SENSOR WITH A REFLECTOR

(75) Inventors: Xiaodong Wu, Roseville, CA (US); James N. Helland, Agoura Hills, CA (US); Leslie K. Green, Applegate, CA (US)

(73) Assignee: Honeywell International Inc., Morristown, NJ (US)

( * ) Notice: Subject to any disclaimer, the term of this patent is extended or adjusted under 35 U.S.C. 154(b) by 1162 days.

This patent is subject to a terminal disclaimer.

(21) Appl. No.: 11/940,038

(22) Filed: Nov. 14, 2007

(65) Prior Publication Data

US 2009/0121958 A1 May 14, 2009

(51) Int. Cl.
*H01Q 19/10* (2006.01)
*H01Q 1/38* (2006.01)

(52) U.S. Cl.
USPC ..... 343/834; 343/700 MS

(58) Field of Classification Search
USPC ..... 343/700 MS, 767, 770, 834, 893
See application file for complete search history.

(56) References Cited

U.S. PATENT DOCUMENTS 7,800,539 B2 * 9/2010 Oomuro ..... 342/383

FOREIGN PATENT DOCUMENTS

WO WO9743662 11/1997

OTHER PUBLICATIONS

Frenzel, Louis E., "Principles of Electronic Communication Systems," Chapter 14 entitled "Antennas and Wave Propagation" Section 14-1 "Antenna Fundamentals", Glencoe, 2nd Edition 2003, pp. 592-641.
2006/2007 draft EN50131-2-4 G3 crawl test, p. 10.

* cited by examiner

*Primary Examiner* — Robert Karacsony
(74) *Attorney, Agent, or Firm* — Husch Blackwell

(57) ABSTRACT

A microwave motion sensor including a patch antenna having a plurality of microwave radiating elements for transmitting and receiving a microwave signal where each microwave radiating element is of the antenna in an array configuration. A reflector is disposed above the antenna for downward shaping the radiating signal, where the microwave radiating elements together with the reflector provide a radiation pattern where a main beam is transmitted in a direction orthogonal to a surface of said antenna and a sided lobe transmitted downward in amplitude below the microwave motion sensor.

8 Claims, 6 Drawing Sheets

FLOOR

CEILING

FLOOR

CEILING

MICROWAVE MOTION SENSOR WITH A REFLECTOR

BACKGROUND OF THE INVENTION

1. Field of Invention

The present invention generally relates to microwave motion sensors and more particularly a plurality of microwave radiating elements including a reflector for enhanced lookdown ability.

2. Description of Prior Art

Increasingly, security systems and automated manufacturing systems, as well as other automated processes are employing microwave (MW) motion sensors for motion detection. MW motion sensors typically include a microwave transceiver which is an active device employing electromagnetic waves lower in frequency than visible light. A MW motion sensor transmits a microwave signal toward a region to be monitored and in the event that movement is detected within the region, the microwave signal is reflected back (echo) from such movement and is modulated due to the Doppler Effect. When a signal is reflected from a moving object (target) it is shifted in frequency. This shift in frequency is called the Doppler Effect and is directly proportional to the targets velocity relative to the sensor. The maximum frequency shift is when the target is moving straight at the sensor and minimum frequency shift is observed if the target is moving at 90 degrees to the target. All Doppler sensors use this principle.

In certain security and other automated applications or systems, a MW sensor may be mounted on a wall to monitor a room or part of a room. In such a situation a microwave reflector is employed to enhance the coverage of the MW motion sensor. For example, a MW transmitter and receiver employing a reflector is described in PCT WO 97/43662.

A front and side view of a prior art MW motion sensor 100 is shown in FIGS. 1A and B. The prior art MW motion sensor includes an antenna 110 having a plurality of microstrip radiating elements (antenna patches) 120 and a strip of copper foil 130 disposed in front of the antenna aperture so as to reflect an upper portion of the emitted radiation from the plurality of microstrip radiating elements 120. FIGS. 1A and 1B depict the antenna aperture of the prior art MW motion sensor 100 as it is well known in the art that an antenna aperture is the portion of a plane surface very near the antenna and normal to the direction of maximum radiant intensity, through which the major part of the radiation passes. In other words, the prior art reflector or strip of copper foil 130 provides enhanced microwave amplitude at low incident angles, thereby effectively reducing a blind zone beneath the microwave transmitters by reflecting part of the main beam.

However, the aforementioned prior art MW motion sensor provides enhanced detection underneath the sensor, but provides this enhanced signal by reflecting part of the main beam. This may be detrimental to detection in the protected region by the main beam from the antenna.

SUMMARY OF THE INVENTION

Accordingly, the present invention provides a motion sensor, which provides enhanced detection beneath the sensor to detect intruders (moving targets) underneath the sensor by reflecting part of the side lobe energy downward without affecting the main beam of the antenna.

In one embodiment of the present invention, a microwave motion sensor is provided including an antenna having a plurality of radiating elements (patch antennas) for transmitting and receiving a microwave signal where each microwave radiating element is attached in an array configuration. A reflector is disposed above the antenna for downward shaping the radiating signal, where the antenna(s) with the reflector provide a radiation pattern in which a main beam is transmitted in a direction orthogonal to a surface of said antenna(s) and a side lobe transmitted downward below the microwave motion sensor.

In another embodiment of the present invention, the antenna is a single patch antenna or a single slot antenna.

In yet another embodiment the plurality of microwave radiating elements are configured in an array of n rows and m columns.

In yet still another embodiment, the reflector is mounted above said antenna and protruding outward and configured to enhance the downward radiation of the antenna.

In a further embodiment, the reflector comprises any material which enhances the downward energy.

BRIEF DESCRIPTION OF THE DRAWINGS

The objects, features and advantages of the present invention will become apparent to one skilled in the art, in view of the following detailed description taken in combination with the attached drawings, in which.

DETAILED DESCRIPTION OF THE INVENTION

A microwave motion sensor having enhanced lookdown ability will now be described in reference to the figures.

Figure 1A:
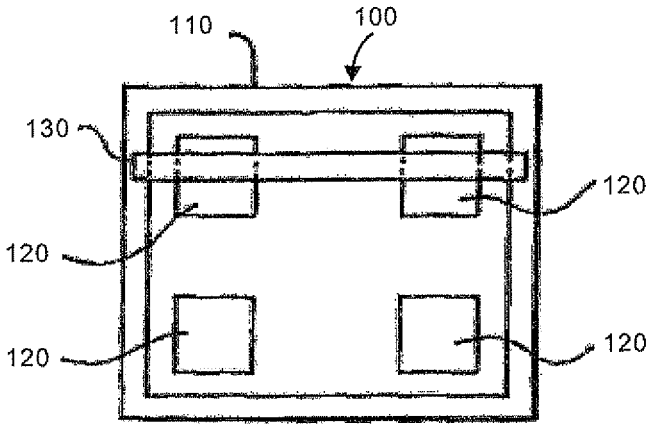
FIG. 1A (Prior Art)
FIGS. 1A and 1B are an illustrations of a front and side view, respectively of the prior art MW motion sensor.
Figure 1B:
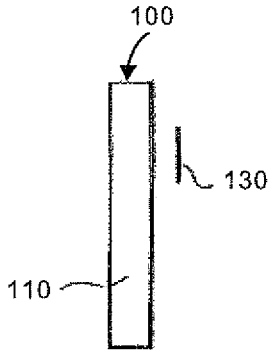
FIG. 1B (Prior Art)
Figure 2:
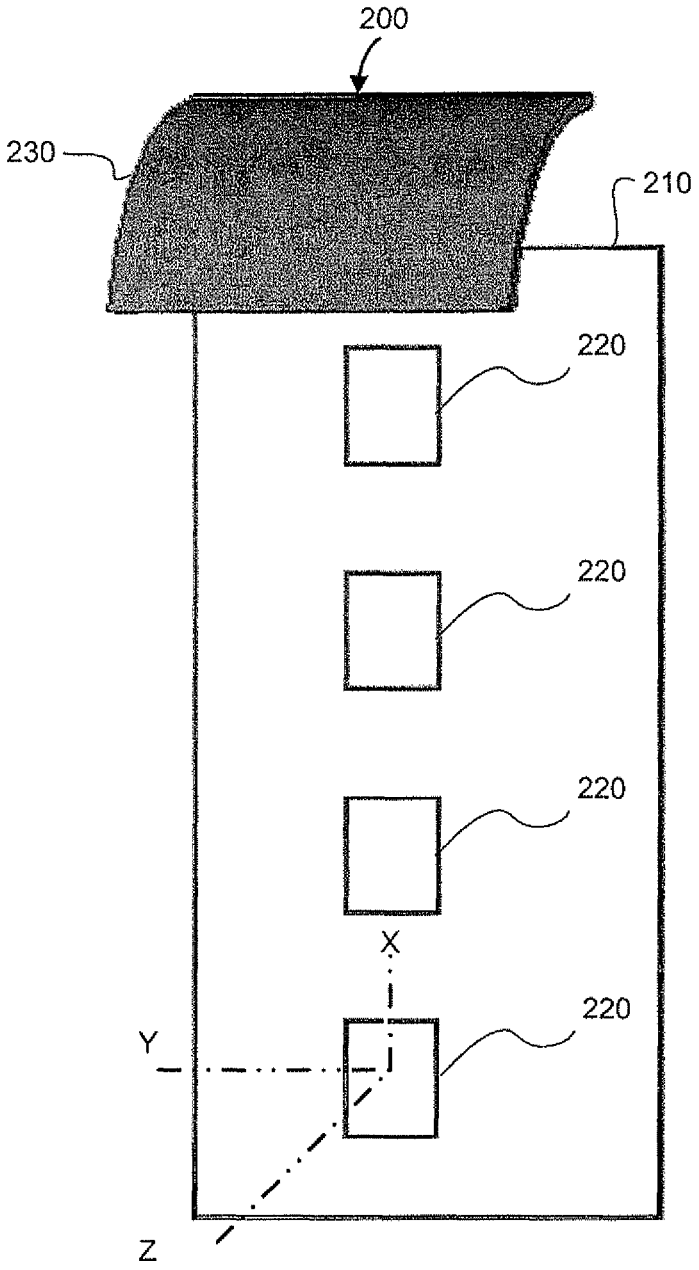
FIG. 2 is an illustration of a microwave motion sensor having a 1×4 array of microwave radiating elements comprising the microwave antenna according to one possible embodiment of the present invention.
Figure 3:
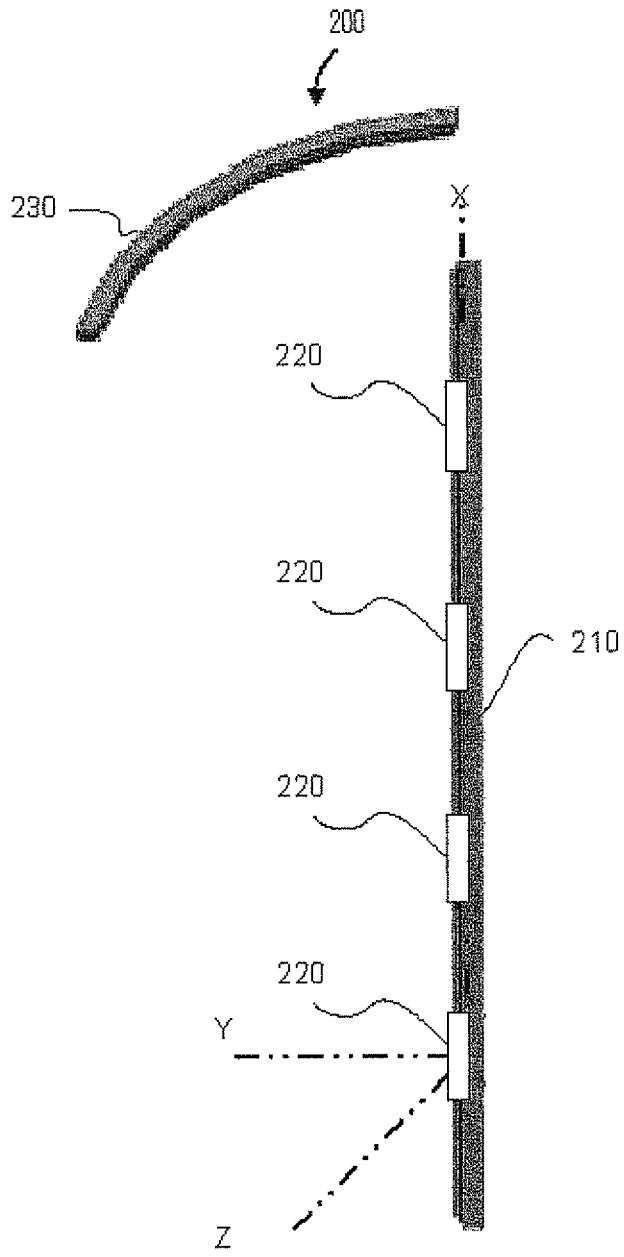
FIG. 3 is an illustration of a side view of the microwave motion sensor having a 1×4 array of microwave radiating elements in FIG. 2.

FIGS. 2 and 3 are illustrations of the front and side view of a microwave motion sensor including a 1×4 array of microwave radiating elements 200 according to one embodiment of the present invention. An antenna 210 is shown with a plurality of microwave radiating elements 220 in a 1×4 array configuration. In addition, a reflector 230 is shown having a curved shape and disposed above the plurality of microwave radiating elements 220. The antenna is not limited to a 1×4 array, but could be any antenna. The reflector is not limited to a curved reflector could be any shape which gives the desired enhanced pattern.

Antenna 220 is a patch antenna which is well known in the art as a metal patch suspended over a ground plane. These patches can be used alone or be part of an antenna array for pattern shaping as shown. In one embodiment, the antenna operates in the k-band, however the present invention is not limited to that spectrum and can operate in other bands as known to those skilled in the art. Each microwave transceiver 200 transmits and receives back microwave signals according to the Doppler principle as discussed above. The antenna could consist of appropriate placed radiating slots instead of patches.

The antenna 210 consisting of the microwave radiating elements 220 provide a specific radiation pattern in appropriate amplitude and phase relationships as known to those skilled in the art. The antenna 210 composed of the radiating elements 220 radiate according to Cartesian coordinates X, Y, and Z. Further shaping the radiation pattern of antenna 210 and the radiating elements 220 is reflector 230.

The reflector 230, according to one embodiment of the present invention can have other dimensions and shapes as known to those skilled in the art taking into account the size of the antenna and the wavelength employed.

Figure 4:
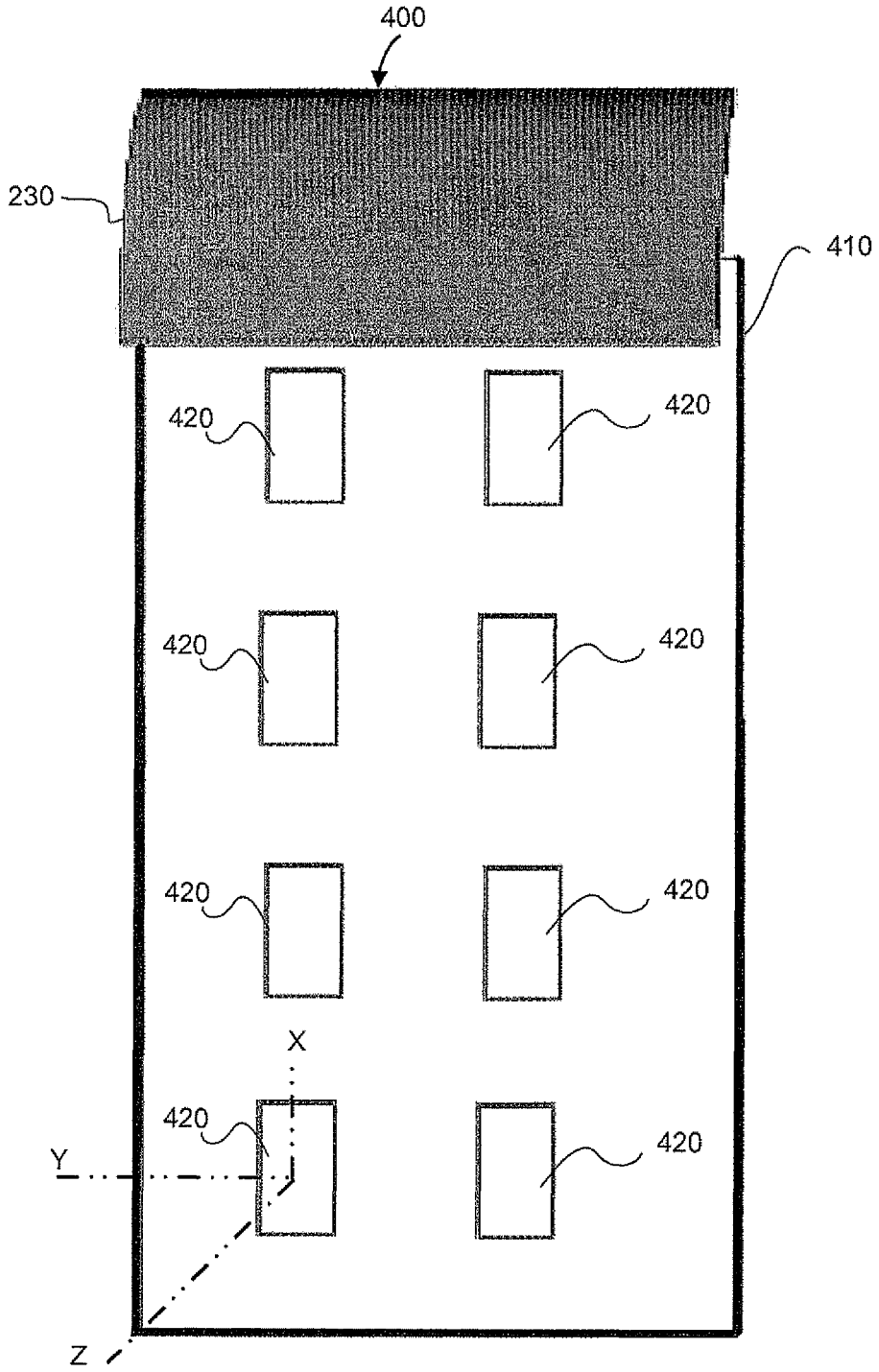
FIG. 4 is an illustration of a microwave motion sensor having a 2×4 array of microwave radiating elements according to another embodiment of the present invention.

FIG. 4 discloses a microwave motion sensor 400 including a 2×4 array of microwave radiating elements 420 according to a second embodiment of the present invention. The array of microwave radiating elements discloses in FIGS. 2 and 4 can be any n×m arrays as known to those skilled in the art. As can be seen in FIG. 4, an antenna 410 consisting of the microwave radiating elements 420 is configured in a 2×4 array configuration. In addition, a reflector 430 is shown having a curved shape and disposed above the plurality of microwave radiating elements 420. The antenna 410 consisting of the microwave radiating elements 420 provide a specific radiation pattern in appropriate amplitude and phase relationships as known to those skilled in the art.

Figure 5:
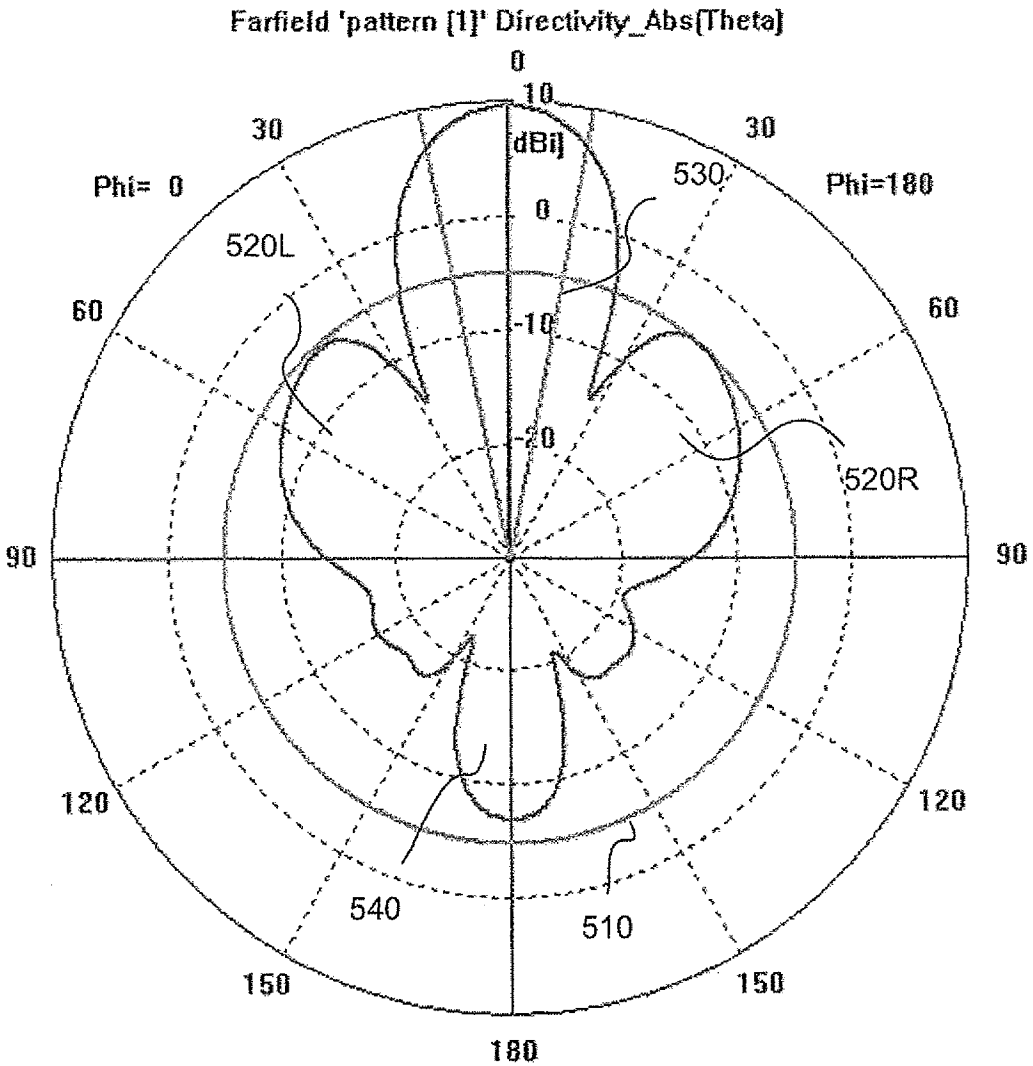
FIG. 5 (Prior Art)
FIG. 5 is an illustration of a radiation pattern of a conventional microwave motion sensor; and as shown in FIG. 4 without the reflector on the top of the antenna array.

FIG. 5 is an illustration of a radiation pattern of a conventional microwave motion sensor. As well known in the art, a radiation pattern of an antenna is a graph showing in cross-section a plane, in this case the vertical plane, that describes the relative far-zone field strength versus direction at a fixed distance from an antenna. In FIG. 5, the directivity of the antenna is proceeding from left to right of the center of the beam. The antenna pattern discloses a well-pronounced main lobe 530 with a left-sided sidelobe 520L and a right-sided sidelobe 520R as well as a back lobe 540. The lobe on the right side represents the antenna looking downward and conversely the left side is the pattern looking up.

Figure 6:
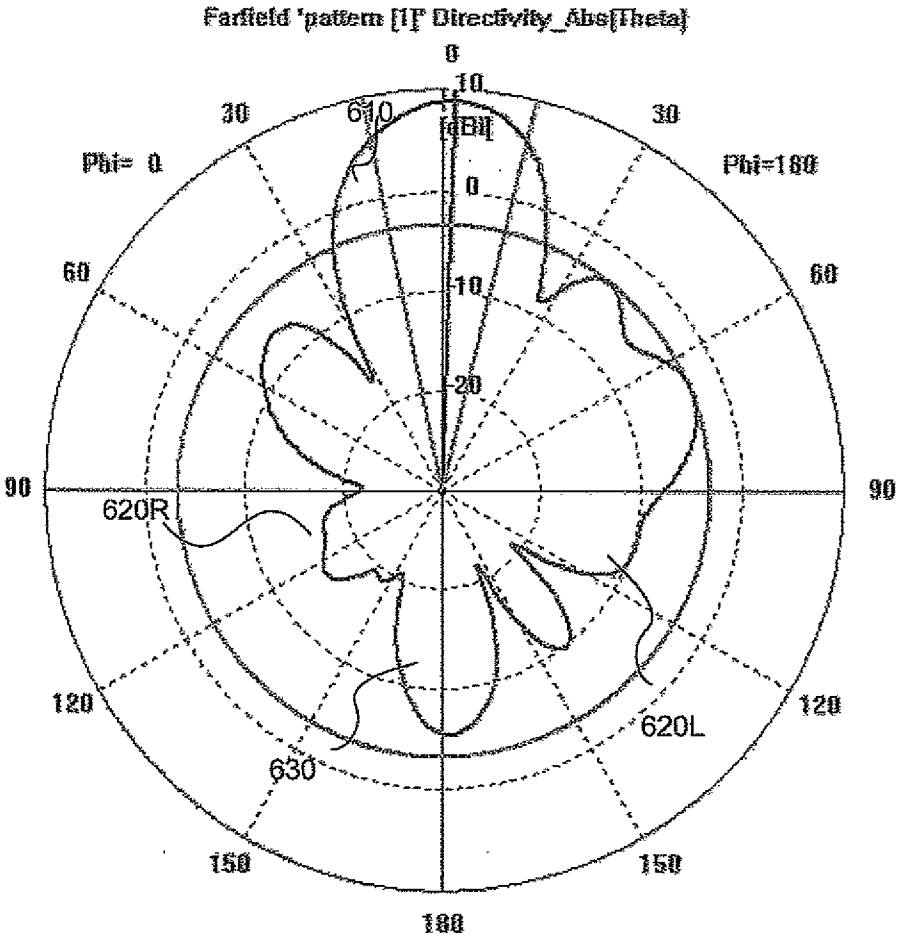
FIG. 6 is an illustration of a radiation pattern of a microwave motion sensor having the reflector as shown in FIG. 4. As can be seen, there is more microwave signal radiating downward in the region shown as 60 to 90 degrees at the bottom of the pattern.

FIG. 6 is an illustration of a radiation pattern of the same microwave motion sensor as described in the preceding paragraph but with a reflector and having a 1×4 array of microwave radiating elements according to one embodiment of FIGS. 2 and 4. As a result of the reflector, the present invention provides for a right-sided side lobe 620R which is much larger than that found in the conventional art as shown in FIG. 5. At the same time, the left-sided lobe 620L and the main lobe 630 remain largely unaffected by the reflector. In other words, the reflector has a minimum influence on the main desired radiation pattern while refocusing the side lob radiation to a desired area below the microwave motion sensor.

One implementation of the present invention is a wall mounted motion sensor for use in intruder detection in the case of security systems. For example as called for in the new 2006/2007 draft EN50131-2-4 G3 crawl test, either the first or second embodiment of the present invention can be mounted on a wall at a height of 10 feet from the floor and still detect an object below within 0.5 meters away from the wall. This requires the antenna to have an enhanced beam width between 60° and 90° of the down-sidelobe 620R. Hence, the present invention provides enhanced coverage directly below the microwave motion detector unlike the motion sensor without the reflector.

While there has been shown and described what is considered to be illustrated embodiments of the invention, it will, of course, be understood that various modifications and changes in form or detail could readily be made without departing from the spirit of the invention. It is therefore intended that the scope of the invention not be limited to the exact forms described and illustrated, but should be construed to cover all modifications that may fall within the scope of the appended claims.

What is claimed is:

1. A microwave motion sensor, comprising:

an antenna having a plurality of microwave radiating elements for transmitting and receiving a microwave signal; and a reflector disposed above said antenna that is constructed for downward shaping said microwave signal, said reflector is curved shaped, wherein said microwave signal transmitted by said microwave radiating elements includes a radiation pattern with at least a main lobe, a first upward looking side lobe, and a second downward looking side lobe, and wherein said microwave signal transmitted by said microwave radiating elements is reflected by said reflector without substantially affecting said main lobe and said first upward looking side lobe of said radiation pattern of said microwave signal transmitted by said microwave radiating elements.

2. The microwave motion sensor of claim 1, wherein said main beam is transmitted in a direction orthogonal to a surface of said antenna and said second downward looking side lobe is transmitted downward in amplitude below the microwave motion sensor.

3. The microwave motion sensor of claim 1, wherein the antenna comprises one or more patch antennas or one or more slot antennas.

4. The microwave motion sensor of claim 1, wherein the plurality of microwave radiating elements are configured in an array of n rows and m columns.

5. The microwave motion sensor of claim 1, wherein the reflector is mounted above said antenna and protruding outward and downward.

6. The microwave motion sensor of claim 5, wherein the reflector is configured to reflect energy downward based upon a predetermined shape of the reflector and produces a desired enhanced pattern.

7. The microwave motion sensor of claim 2, wherein said second downward looking side lobe is larger than said second downward looking side lobe would be if no reflector were provided.

8. The microwave motion sensor of claim 7, wherein said reflector is positioned such that the main beam and the first upward looking side lobe are substantially unaffected as compared to if no reflector were provided.

* * * * *